United States Patent [19]

Kadija

[11] 4,165,271

[45] Aug. 21, 1979

[54] DIAPHRAGMS FOR USE IN THE ELECTROLYSIS OF ALKALI METAL CHLORIDES

[75] Inventor: Igor V. Kadija, Cleveland, Tenn.

[73] Assignee: Olin Corporation, New Haven, Conn.

[21] Appl. No.: 838,600

[22] Filed: Oct. 3, 1977

[51] Int. Cl.[2] ..... C25B 1/46; C25B 13/08

[52] U.S. Cl. ..... 204/252; 204/98; 204/282; 204/296

[58] Field of Search ..... 204/98, 283, 295, 296, 204/252

[56] References Cited

U.S. PATENT DOCUMENTS

| | | | |
|---|---|---|---|
| 2,116,509 | 5/1938 | Cottrell | 204/283 UX |
| 3,022,244 | 2/1962 | LeBlanc et al. | 204/266 |
| 3,407,249 | 10/1968 | Landi | 204/296 X |
| 3,424,659 | 1/1969 | Staal | 204/74 |
| 3,702,267 | 11/1972 | Grot | 429/34 |
| 3,775,272 | 11/1973 | Danna | 204/98 |
| 3,923,630 | 12/1975 | Argade et al. | 204/266 |
| 4,032,427 | 6/1977 | Kadija | 204/283 |
| 4,033,837 | 7/1977 | Kud et al. | 204/98 |

FOREIGN PATENT DOCUMENTS

| | | | |
|---|---|---|---|
| 7249424 | 12/1972 | Japan | 204/296 |
| 26770 | 3/1975 | Japan | 204/296 |
| 12662 | of 1893 | United Kingdom | 204/295 |
| 7950 | of 1894 | United Kingdom | 204/295 |
| 245127 | 3/1927 | United Kingdom | 204/295 |

OTHER PUBLICATIONS

Hackh's Chemical Dictionary, 3rd Ed. by Grant, pp. 78, 233, 536, 829 pub. by Blakiston, Philadelphia 1944.

*Primary Examiner*—F. C. Edmundson

*Attorney, Agent, or Firm*—James B. Haglind; Donald F. Clements

[57] ABSTRACT

A diaphragm for use in the electrolysis of alkali metal chloride brines in electrolytic diaphragm cells is comprised of a support fabric impregnated with a non-fibrilic active component containing silica. The support fabric has a non-continuous coating of an electroconductive metal on one side of the fabric. Suitable electroconductive metals include nickel, nickel alloys, gold, gold alloys, platinum group metals, platinum group metal alloys, and mixtures thereof.

The diaphragms are physically and chemically stable, provide reduced cell voltages during operation of the cell and have increased operational life.

30 Claims, No Drawings

DIAPHRAGMS FOR USE IN THE ELECTROLYSIS OF ALKALI METAL CHLORIDES

This invention relates to diaphragm-type electrolytic cells for the electrolysis of aqueous salt solutions. More particularly, this invention relates to novel diaphragms for electrolytic diaphragm cells.

In an electrolytic diaphragm cell, the diaphragm represents the cell component which permits the cell to operate by producing, where the electrolyte is an alkali metal chloride brine, an alkali metal hydroxide at current efficiencies which are high enough to be economically viable. The separation properties, as indicated by the current efficiencies, can be increased by, for example, increasing the thickness or density of the diaphragm. These changes, however, usually result in an increase in the electrical resistance of the diaphragm, as indicated, for example, by an increase in the voltage coefficient. Favorable cell economics depend on increasing or maintaining at a high level the current efficiency while restraining or minimizing the increase in voltage coefficient.

It is an object of the present invention to provide a diaphragm having efficient separation properties and providing reduced cell voltage during cell operation.

Another object of the present invention is to provide a diaphragm having increased stability and a longer operational life when employed in the electrolysis of alkali metal chloride brines.

A further object of the present invention is a diaphragm having support materials which are chemically and physically stable during electrolysis.

A still further object of the present invention is the use of ecologically acceptable non-polluting materials in diaphragms.

These and other objects of the invention are accomplished in a porous diaphragm for an electrolytic cell for the electrolysis of alkali metal chloride brines which comprises a support fabric impregnated with a non-fibrilic active component containing silica, the support fabric having on one side a non-continuous coating of an electroconductive metal selected from the group consisting of nickel, nickel alloys, gold, gold alloys, platinum group metals, alloys of platinum group metals, and mixtures thereof.

More in detail, the novel diaphragms of the present invention comprise a support fabric of a thermoplastic material which is non-conducting and stable to the gases and solutions found in the cell. The support fabric is impregnated with an active component containing silica, for example, sand, colloidal silica, alkali metal silicates, alkaline earth metal silicates, aluminum silicate as well as related mineral products. The impregnated diaphragm has suitable separation properties, however, the electrical resistance is higher than desired. To reduce this resistance, the support fabric is coated on at least one side, with an electroconductive metal. Any suitable electroconductive metal may be used which is stable to the cell environment and does not interact with other cell components. For example, nickel, nickel alloys, gold, gold alloys, platinum group metals, alloys of platinum group metals, and mixtures thereof, are suitable electroconductive metals for coating the novel diaphragms of the present invention. The term "platinum group metal" as used in the specification means an element of the group consisting of platinum, ruthenium, rhodium, palladium, osmium and iridium.

Preferred electroconductive metals are nickel, nickel alloys and platinum group metals and their alloys. Suitable nickel alloys include those containing molybdenum or molybdenum and vanadium, for example, alloys comprising from about 78 to about 90 percent by weight of nickel, and about 0.2 to about 1.5 percent by weight of vanadium, and about 10 to about 20 percent by weight of molybdenum; or from about 80 to about 90 percent by weight of nickel and from about 10 to about 20 percent by weight of molybdenum. It is further preferred that where the coated side of the diaphragm will face the cathode, the electroconductive metal coating be that of nickel or nickel alloys, and where the coated side of the diaphragm will face the anode, the electroconductive metal coating be that of a platinum group metal or an alloy of a platinum group metal.

Coatings of these metals are applied to the support fabric by known methods such as electroplating, catalytic chemical methods ("electroless plating"), as well as painting or spreading the metal where applicable.

In order to maintain the desired porosity or permeability of the diaphragm, the metal coating is applied to provide a non-continuous coverage of the fabric. The coatings are substantially surface coatings and penetration of the electroconductive metal into the fabric is minimal. Metal penetration into the fabric support is suitably no greater than about 10 percent and preferably from about 1 to about 5 percent of the thickness of the support fabric.

To aid in the evaluation of the coating, it may be desirable to measure the electrical conductivity of the coating at various stages during application of the metal. This can be done with, for example, two needle-like electrodes plated, for example, with nickel and connected to an Ohm meter. The electrodes, which are spaced apart a distance of one centimeter and have a contact surface of one square millimeter are pressed against the metal coated side of the diaphragm at a pressure of 1 kilogram per centimeter and the resistance measured. Suitably coated diaphragms are those having a resistance of less than about 30 Ohms, for example, from about 10 to about 0.01 Ohms.

The support fabrics may be coated with the electroconductive metal prior to or after impregnation with the active silica containing component. It is, however, frequently more convenient to apply the non-continuous metal coating to the support fabric prior to its impregnation with the silica component.

Diaphragms having the electroconductive coating may be installed in an electrolytic cell so that the coated surface is facing either the cathode or the anode. When the coated side of the diaphragm is facing the anode, it is believed that the metal coating serves to increase the service life of the diaphragm. Placing the coated side of the diaphragm adjacent to the cathode provides reduced electrical resistance. In a preferred embodiment, the side of the diaphragm having the electroconductive metal coating is adjacent to the cathode.

If desired, an electroconductive metal coating may be placed on each side of the diaphragm using, for example, nickel or a nickel alloy on the side which will face the cathode and a platinum group metal on the side which will face the anode. Control of the penetration of the metal coating into the support fabric is particularly important when both sides are coated in order to prevent the entire diaphragm from becoming electroconductive.

No electrical leads or contacts to the diaphragm are required during operation of the cell using the novel diaphragms of the present invention.

The metal coated porous diaphragm of the present invention has as its active ingredient, a non-fibrilic component containing silica. For the purposes of this invention, silica is equivalent to silicon dioxide. The component containing silica should be capable of undergoing hydration when in contact with the electrolytes in the cell. A large number of silica-containing materials can be used including sand, quartz, silica sand, colloidal silica, as well as chalcedony, cristobalite and tripolite. Also suitable are alkali metal silicates such as sodium silicate, potassium silicate and lithium silicate, alkaline earth metal silicates such as magnesium silicates or calcium silicates, and aluminum silicates. In addition, a number of minerals can be suitably used as the silica-containing ingredient including magnesium-containing silicates such as sepiolites, meerschaums, augites, talcs, and vermiculites, magnesium-aluminum-containing silicates such as attapulgites, montmorillonites and bentonites, and alumina-containing silicates such as albites, feldspars, labradorites, microclines, nephelites, orthoclases, pyrophyllites, and sodalites, as well as natural and synthetic zeolites.

When using as the active component a silica component such as sand, quartz, silica sand, colloidal silica, chalcedony, cristobalite, tripolite and alkali metal silicates, it may be desirable to include an additive which provides improved ionic conductivity and cation exchange properties. Suitable additives include, for example, magnesia, magnesium acetate, magnesium aluminate, magnesium carbonate, magnesium chloride, magnesium hydroxide, magnesium oxide, magnesium peroxide, magnesium silicate, magnesite, periclase, dolomites, alumina, aluminum acetate, aluminum chlorate, aluminum chloride, aluminum hydroxide, aluminum oxides ($\alpha$, $\beta$ and $\gamma$), aluminum silicate, corundum, bauxites as well as lime, lithium salts such as lithium chloride and lithium nitrate, and inorganic phosphates such as aluminum phosphates and sodium phosphates.

The additives may be used in amounts of from about 10 to about 70 and preferably from about 20 to about 50 percent by weight of the active component containing silica.

The presence of metals other than alkali metals, alkaline earth metals and aluminum can be tolerated at low concentrations. For example, the concentration of metals such as Fe, Ni, Pb, Ag as well as other heavy metals which may be present in the alkali metal chloride brines electrolyzed are preferably below one part per million. Where these metals are found in the silica-containing materials, it is preferred that their concentration be less than about 5 percent of the concentration of silicon present in the material.

Concentrations of non-metallic materials such as fluorine or ammonia as well as organic compounds should also be maintained at moderate or preferably low levels.

The degree to which the active component containing silica is hydrated is the basis for selecting suitable particle sizes of the component. For those materials which are readily hydrated in the electrolyte solutions used or produced in the cell, a particle size as large as about 100 microns is satisfactory. Where the component is less easily hydrated, the particle size may be substantially reduced. For these materials, particles having a size in the range of from about 75 microns to about one micron are more suitable.

As a support material for the active component containing silica, a fabric is employed which is produced from thermoplastic materials which are chemically resistant to and dimensionally stable in the gases and electrolytes present in the electrolytic cell. The fabric support is substantially non-swelling, non-conducting and non-dissolving during operation of the electrolytic cell.

The fabric support has a thickness of from about 0.04 to about 0.33, preferably from about 0.06 to about 0.25, and more preferably from about 0.09 to about 0.18 of an inch. The fabric support is non-rigid and is sufficiently flexible to be shaped to the contour of an electrode, if desired.

Suitable fabric supports are those which can be handled easily without suffering physical damage. This includes handling before and after they have been impregnated with the active component. Suitable support fabrics can be removed from the cell following electrolysis, treated or repaired, if necessary, and replaced in the cell for further use without suffering substantial degradation or damage.

Support fabrics having uniform permeability throughout the fabric are quite suitable in diaphragms of the present invention. Prior to impregnation with the active component containing silica and coating with the electroconductive metal, these support fabrics should have a permeability to gases such as air of, for example, from about 1 to about 500, and preferably from about 50 to about 100 cubic feet per minute per square foot of fabric. However, fabrics having greater or lesser air permeability may be used. Uniform permeability throughout the support fabric is not, however, required and it may be advantageous to have a greater permeability in the portion of the support fabric which, when impregnated, will be positioned closest to the anode in the electrolytic cell. Layered structures thus may be employed as support fabrics having, a first layer which when the diaphragm is installed in the cell, will be in contact with the anolyte, and a second layer which will be in contact with the catholyte. The first layer may have, for example, a thickness of from about 0.09 to about 0.187 of an inch and an air permeability of, for example, from about 100 to about 500 cubic feet per minute. The first layer, may be, for example, a net having openings which are slightly larger than the particle size of the active ingredient with which it is impregnated.

The second layer, in contact with the catholyte when installed in the cell, may, for example, have a thickness of from about 0.03 to about 0.125 of an inch and an air permeability, for example, of from about 1 to about 15 cubic feet per minute. For the purpose of using a selected size of active component containing silica, the layered support fabric can be produced by attaching, for example, a net to a felt. The net permits the particles to pass through and these are retained on the felt.

Suitable permeability values for the support fabric may be determined, for example, using American Society for Testing Materials Method D737-75, Standard Test Method for Air Permeability of Textile Fabrics.

The support fabrics may be produced in any suitable manner. Suitable forms are those which promote absorption of the active component including sponge-like fabric forms. A preferred form of support fabric is a felt fabric.

Materials which are suitable for use as support fabrics include thermoplastic materials such as polyolefins which are polymers of olefins having from about 2 to about 6 carbon atoms in the primary cabin as well as their chloro- and fluoro- derivatives.

Examples include polyethylene, polypropylene, polybutylene, polypentylene, polyhexylene, polyvinyl chloride, polyvinylidene chloride, polytetrafluoroethylene, fluorinated ethylene-propylene (FEP), polychlorotrifluoroethylene, polyvinyl fluoride, polyvinylidene fluoride, and copolymers of ethylene-chlorotrifluoroethylene.

Preferred olefins include the chloro- and fluoro- derivatives such as polytetrafluoroethylene, fluorinated ethylene-propylene, polychlorotrifluoroethylene, polyvinyl fluoride, and polyvinylidene fluoride.

Also suitable as support materials are fabrics of polyaromatic compounds such as polyarylene compounds. Polyarylene compounds include polyphenylene, polynaphthylene and polyanthracene derivatives. For example, polyarylene sulfides such as polyphenylene sulfide or polynaphthylene sulfide. Polyarylene sulfides are well known compounds whose preparation and properties are described in the *Encyclopedia of Polymer Science and Technology,* (Interscience Publishers) Vol. 10, pages 653–659. In addition to the parent compounds, derivatives having chloro-, fluoro- or alkyl substituents may be used such as poly(perfluorophenylene) sulfide and poly(methylphenylene) sulfide.

In addition, fabrics which are mixtures of fibers of polyolefins and polyarylene sulfides can be suitably used.

The support fabrics may be impregnated with the active component containing silica in any of several ways. For example, a slurry of the active component in a solution such as cell liquor, is prepared and the support fabric is impregnated by soaking in the slurry. Another method is to attach the supporting fabric to the cathode and immerse the cathode in the slurry, using suction means to draw the slurry through the support fabric.

It is not necessary to employ a solution or slurry for impregnation purposes. For example, the active component containing silica may be used to form a fluidized bed. A vacuum is employed to suck the particles into the support fabric until the desired degree of impregnation is obtained.

When impregnated, the novel diaphragm of the present invention contains from about 10 to about 75, and preferably from about 30 to about 50 milligrams per square centimeter of the active component containing silica.

Following impregnation with the active component containing silica, the diaphragms have a permeability to alkali metal chloride brines of from about 100 to about 300, and preferably from about 150 to about 250 milliliters per minute per square meter of diaphragm at a head level difference between the anolyte and the catholyte of from about 0.1 to about 20 inches of brine.

In order to provide similar brine permeability rates, deposited asbestos fiber diaphragms require a greater thickness which results in higher electrical resistance as indicated by larger voltage coefficients at comparable operating conditions. The novel diaphragms of the present invention are thus more energy efficient than deposited asbestos diaphragms and provide reduced power costs.

The novel diaphragms of the present invention have handling properties which far exceed those of, for example, asbestos. The supported diaphragms can be removed from the cell, washed or treated to restore flowability, and replaced in the cell without physical damage. During operation of the cell, the novel diaphragms remain dimensionally stable with the support material neither swelling nor being dissolved or deteriorated by the electrolyte, the active component containing silica or the cell products produced.

Electrolytic cells in which the diaphragms of the present invention may be used are those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. The cells have an anode assembly containing a plurality of foraminous metal anodes, a cathode assembly having a plurality of foraminous metal cathodes with the novel diaphragm separating the anodes from the cathodes. Suitable electrolytic cells include, for example, those types illustrated by U.S. Pat. Nos. 1,862,244; 2,370,087; 2,987,463; 3,247,090; 3,477,938; 3,493;487; 3,617,461; and 3,642,604.

When employed in electrolytic cells, the diaphragms of the present invention are sufficiently flexible so that they may be mounted on or supported by an electrode such as a cathode During electrolysis or when in contact with the catholyte liquor produced in the cell, the active component containing silica produces a gel-like formation which is permeable to alkali metal ions. While the gel-like formations may be produced throughout the diaphragm, they are normally produced within the support fabric in the portion which is adjacent to the anolyte side. The extent of gel formation within the support fabric varies, for example, with the thickness of the support fabric and the concentration of alkali metal hydroxide in the catholyte liquor. Preferred diaphragms are those which have a gel-free portion in contact with the catholyte having a thickness of from about 0.03 to about 0.06 of an inch. Gel formation is believed to occur during hydration of the active component containing silica. The gel is believed to be soluble in the catholyte liquor and it is desirable that the rate of dissolution be controlled to maintain a suitable equilibrium between gel formation and dissolution for efficient operation of the cell. Introduction of cations such as Mg, Al and Ca into the gel is believed to be one way of increasing the stability of the gel and thus reduce its rate of dissolution. Another way appears to be the selection of suitable particle size for the active component containing silica. Efficient cell operation is attained by controlling the equilibrium sufficiently to produce a caustic liquor containing silica in amounts of from about 10 to about 150 parts per million. This may be obtained by periodically adding the active component containing silica to the brine in suitable amounts. Alkali metal chloride brines used in the electrolytic process normally contain concentrations of silica of from about 10 to about 30 parts per million and thus the brine may supply sufficient silica to maintain the equilibrium and supplemental addition of silica may not be necessary.

The porous diaphragms of the present invention are illustrated by the following examples without any intention of being limited thereby.

EXAMPLE 1

A section of polytetrafluoroethylene felt having a thickness of 0.068 of an inch was sprayed on one side with a silver metallizing paint. The silver paint was applied in a manner which provided a non-continuous coating on the felt and which minimized penetration of the paint into the felt. Electrical conductivity of the painted fabric was determined by contacting the painted surface with two nickel plated, needle-like electrodes, each having a contact surface of one square millimeter. The electrodes, each connected to an Ohm meter, were pressed against the painted side at a pressure of one kilogram per square meter. A distance of one centimeter separated the two electrodes. Silver spraying was discontinued when the resistance was below about 0.1 Ohm. After drying, the painted felt was immersed in an electroplating bath containing an aqueous nickel plating solution containing:

nickel sulfate—300 grams per liter
nickel chloride—60 grams per liter
boric acid—6 grams per liter
sodium molybdate—0.3 grams per liter
vanadyl sulfate—0.4 grams per liter A current of 0.02 $KA/m^2$ was passed through the solution for a period of about 4 hours, then the current increased to 0.1 $KA/m^2$ for an additional 2 hours. Electroplating was completed employing a current of 0.4 to 0.6 $KA/m^2$ for about 2 hours. After removal from the plating bath, the felt, coated with a nickel-molybdenum-vanadium alloy, was rinsed in tap water and then washed with a 20 percent solution of caustic soda. The felt was fitted on a louvered steel mesh cathode with the coated side in contact with the cathode surface.

The felt covered cathode was immersed in a sodium chloride brine (295–305 gpl of NaCl) having dispersed therein about 5 percent by volume of sepiolite. Analysis of the sepiolite indicated oxides of the following elements were present as percent by weight: Si 79.1; Mg 9.3; K 4.8; Ca 4.8; Al 1.4; and Fe 1.4.

A vacuum was applied to impregnate the felt with the dispersion until a vacuum of 23 to 27 inches was reached. The vacuum was shut off and the procedure repeated three times.

The impregnated, felt-covered cathode was installed in an electrolytic cell employing a ruthenium oxide coated titanium mesh anode and sodium cloride brine at pH of 12, a concentration of 315–320 grams of NaCl per liter and a temperature of 90° C. Current was passed through the brine at a density of 2.0 kiloamps per square meter of anode surface. The initial brine head level was 0.5 to 1 inch greater in the anode compartment than in the cathode compartment. The permeability of the impregnated diaphragm was found to be in the range of from about 200 to about 250 milliliters per square meter of diaphragm by measuring the rate of catholyte liquor produced. The cell was operated for six weeks to produce a catholyte liquor having a concentration of 131–188 grams per liter of NaOH at a cathode current efficiency range of 87 to 94 percent. Cell voltage was in the range of 3.1 to 3.2 volts. The catholyte liquid produced had a sodium chloride concentration in the range of 130–170 grams per liter.

COMPARATIVE EXAMPLE

A polytetrafluoroethylene felt having a thickness of 0.068 of an inch thick was impregnated with sepiolite using the procedure of Example 1. The felt, however, had not been previously coated on one side with the Ni alloy. The impregnated felt was then fitted to a louvered steel mesh cathode and electrolysis of sodium chloride conducted in the same cell and employing identical conditions and brine concentration. A catholyte liquor having a concentration equivalent to that of Example 1 was obtained at current efficiencies of 87–94 percent, however, the cell voltage was in the range of 3.2 to 3.4 volts.

Employing the diaphragm of Example 1 having a non-continuous metal coating results in a substantial decrease in cell voltage over the use of an uncoated diaphragm.

EXAMPLE 2

A section of polypropylene felt fabric having an air permeability of about 5 cubic feet per minute was coated with a thin non-continuous coating of nickel using the procedure of Example 1. The nickel-coated polypropylene felt was then impregnated with sepiolite using the identical procedure of Example 1. After impregnation, the diaphragm was fitted on a louvered steel cathode so that the nickel coated side was adjacent to the anode. When employed in the cell of and using the electrolysis method of Example 1, the diaphragm was operated satisfactorily for a period of one month at a cell voltage in the range of 3.4 to 3.7 volts to produce a catholyte liquor having a concentration of 135±20 gpl of NaOH at a cathode current efficiency of 90±2 percent.

COMPARATIVE EXAMPLE

A section of polypropylene felt identical to that used in Example 2 was impregnated with sepiolite in the same manner as that of Example 2. The felt, however, was not coated with an electroconductive metal. When employed in the cell of Example 1 and using the electrolysis method of that Example, the polypropylene felt diaphragm was destroyed in less than one week of cell operation.

Example 2 thus shows that an electroconductive metal coating on the side of the diaphragm facing the anode substantially increases the service life of the diaphragms.

What is claimed is:

1. In an electrolytic diaphragm cell for the electrolysis of alkali metal chloride brines having an anode assembly containing a plurality of foraminous metal anodes, a cathode assembly containing a plurality of foraminous metal cathodes, a diaphragm covering said cathodes, and a cell body housing said anode assembly and said cathode assembly, the improvement which comprises a porous diaphragm comprising a substantially non-conducting support fabric impregnated with a non-fibrilic active component containing silica, said support fabric having on one side a non-continuous coating of an electroconductive metal selected from the group consisting of nickel, silver, gold, platinum group metals, alloys and mixtures thereof.

2. A porous diaphragm for an electrolytic cell for the electrolysis of alkali metal chloride brines which comprises a substantially non-conducting support fabric impregnated with a non-fibrilic active component containing silica, said support fabric having on one side a non-continuous coating of an electroconductive metal selected from the group consisting of nickel, nickel alloys, gold, gold alloys, platinum group metals, platinum group metal alloys and mixtures thereof.

3. The porous diaphragm of claim 2 in which said active component containing silica is present at a concentration of from about 10 to about 75 milligrams per square centimeter of support fabric.

4. The porous diaphragm of claim 3 in which said support fabric has a thickness of from about 0.04 to about 0.33 of an inch.

5. The porous diaphragm of claim 4 in which said active component containing silica is selected from the group consisting of sand, quartz, silica sand, colloidal silica, chalcedony, cristobalite and tripolite.

6. The porous diaphragm of claim 5 having an additive containing magnesium selected from the group consisting of magnesia, magnesium acetate, magnesium aluminate, magnesium carbonate, magnesium chloride, magnesium hydroxide, magnesium oxide, magnesium peroxide, magnesium silicate, magnesite, periclase, dolomites and mixtures thereof, said additives being employed in amounts of from about 10 to about 70 percent by weight of said active component containing silica.

7. The porous diaphragm of claim 5 having an additive containing aluminum selected from the group consisting of alumina, aluminum acetate, aluminum chlorate, aluminum chloride, aluminum hydroxide, aluminum oxides ($\alpha$, $\beta$ and $\gamma$), aluminum silicate, corundum, bauxites and mixtures thereof, said additives being employed in amounts of from about 10 to about 70 percent by weight of said active component containing silica.

8. The porous diaphragm of claim 4 in which said active component containing silica is selected from the group consisting of magnesium silicates, sepiolites, meerschaums, augites, talcs, vericulites, and mixtures thereof.

9. The porous diaphragm of claim 8 in which said support fabric is a polyolefin selected from the group consisting of olefins having from 2 to about 6 carbon atoms and their chloro- and fluoro- derivatives.

10. The porous diaphragm of claim 9 in which said support fabric has an air permeability of from about 50 to about 100 cubic feet per minute per square foot of support fabric.

11. The porous diaphragm of claim 10 in which the penetration of said electroconductive metal in said non-continuous coating is no greater than about 10 percent of the thickness of said support fabric.

12. The porous diaphragm of claim 11 in which said support fabric is a polyolefin selected from the group consisting of polypropylene, polytetrafluoroethylene, fluorinated ethylene-propylene, polychlorotrifluoroethylene, polyvinyl fluoride and polyvinylidene fluoride.

13. The porous diaphragm of claim 12 in which said support fabric has a thickness of from about 0.06 to about 0.25 of an inch.

14. The porous diaphragm of claim 13 in which the electrical resistance of said diaphragm is less than about 30 Ohms.

15. The porous diaphragm of claim 14 in which said active component containing silica is dispersed in said support fabric at a concentration of from about 30 to about 50 milligrams per square centimeter of support fabric.

16. The porous diaphragm of claim 15 in which said polyolefin compound is selected from the group consisting of polypropylene, polytetrafluoroethylene and polyvinylidene fluoride.

17. The porous diaphragm of claim 16 in which said support fabric is a felt fabric.

18. The porous diaphragm of claim 17 in which said electroconductive metal is nickel or nickel alloys.

19. The porous diaphragm of claim 18 in which said active component containing silica is selected from the group consisting of magnesium silicates, sepiolites, and meerschaums.

20. The porous diaphragm of claim 19 in which said active component containing silica is sepiolites.

21. The porous diaphragm of claim 20 in which said polyolefin compound is polytetrafluoroethylene.

22. The porous diaphragm of claim 21 in which said penetration of said electroconductive metal in said non-continuous coating is from about 1 to about 5 percent of the thickness of said support fabric.

23. The porous diaphragm of claim 22 in which said electroconductive metal is a nickel-molybdenum-vanadium alloy.

24. The porous diaphragm of claim 23 in which said nickel-molybdenum-vanadium alloy comprises from about 78 to about 90 percent by weight of nickel, about 0.2 to about 1.5 percent by weight of vanadium, and about 10 to about 20 percent by weight of molybdenum.

25. The porous diaphragm of claim 20 in which said polyolefin compound is polyvinylidene fluoride.

26. The porous diaphragm of claim 20 in which said polyolefin compound is polypropylene.

27. The porous diaphragm of claim 26 in which said electroconductive metal is a platinum group metal or platinum group metal alloy.

28. The porous diaphragm of claim 8 in which said support fabric is a polyarylene sulfide selected from the group consisting of polyphenylene sulfide, polynaphthalene sulfide, poly(perfluorophenylene) sulfide, and poly(methylphenylene) sulfide.

29. The porous diaphragm of claim 28 in which said support fabric is polyphenylene sulfide.

30. The porous diaphragm of claim 29 in which said support fabric is a felt fabric having a thickness of from about 0.06 to about 0.25 of an inch.

* * * * *